US007607463B2

(12) United States Patent
Huber

(10) Patent No.: US 7,607,463 B2
(45) Date of Patent: Oct. 27, 2009

(54) BILLFOLD WITH INTEGRATED NOTEPAD AND WRITING UTENSIL

(76) Inventor: Bryan Huber, 4789 Dawes St., San Diego, CA (US) 92109

( * ) Notice: Subject to any disclaimer, the term of this patent is extended or adjusted under 35 U.S.C. 154(b) by 204 days.

(21) Appl. No.: 11/761,294

(22) Filed: Jun. 11, 2007

(65) Prior Publication Data

US 2008/0302455 A1 Dec. 11, 2008

(51) Int. Cl.
*A45C 1/06* (2006.01)

(52) U.S. Cl. ..... 150/135; 150/137; 150/147; 206/37; 206/38; 206/214; 281/44

(58) Field of Classification Search ..... 206/38, 206/214, 37, 215, 224, 575; 281/44; 150/132, 150/134, 137, 147, 131, 135, 138, 144
See application file for complete search history.

(56) References Cited

U.S. PATENT DOCUMENTS

| | | | | | |
|---|---|---|---|---|---|
| 781,948 | A * | 2/1905 | Hegele | 281/19.1 |
| 1,663,120 | A * | 3/1928 | Cosper | 281/45 |
| D115,284 | S * | 6/1939 | Rosenberg | D6/470 |
| 2,479,472 | A * | 8/1949 | Coplon | 206/37 |
| 2,953,397 | A * | 9/1960 | Diamond | 281/15.1 |
| 3,454,069 | A * | 7/1969 | Machler | 150/137 |
| 4,716,948 | A | 1/1988 | Brissette | |
| 4,741,372 | A | 5/1988 | Santilli | |
| 5,199,573 | A * | 4/1993 | Gribovsky | 206/579 |
| 5,222,764 | A | 6/1993 | Dyer | |
| 6,231,225 | B1 * | 5/2001 | Bedol | 708/106 |
| 6,298,119 | B1 * | 10/2001 | Shaffer et al. | 379/29.07 |
| 6,435,236 | B2 * | 8/2002 | Gribovsky | 150/137 |
| 6,554,519 | B1 | 4/2003 | Kaplan | |
| 6,619,349 | B2 | 9/2003 | Gribovsky | |
| 6,682,352 | B2 * | 1/2004 | Lopez | 434/408 |
| D523,473 | S | 6/2006 | Regala | |
| 2002/0088516 | A1 * | 7/2002 | Olson | 150/147 |
| 2006/0043727 | A1 * | 3/2006 | Brown | 281/30 |

* cited by examiner

*Primary Examiner*—Sue A Weaver
(74) *Attorney, Agent, or Firm*—G. L. Loomis & Associates, Inc.; Gary L. Loomis

(57) ABSTRACT

A billfold or pocket wallet for carrying paper money, credit cards, identification cards and the like comprising means to carry a paper notepad and a writing utensil integrated therein. The billfold is constructed to allow for the facile removal of single sheets from the notepad and the billfold is dimensioned to be conveniently carried in a clothing pocket.

14 Claims, 4 Drawing Sheets

BILLFOLD WITH INTEGRATED NOTEPAD AND WRITING UTENSIL

FIELD OF THE INVENTION

The present invention relates generally to pocket organizers, and more particularly to billfold or pocket wallet for carrying paper money, credit cards, identification cards and the like comprising means to carry a paper notepad and a writing utensil integrated therein.

BACKGROUND

There are many known types of pocket organizers, wallets, billfolds and similar receptacles that are designed to keep items such as credit and identification cards, paper money and the like in an orderly, compact arrangement while carried within a clothing pocket. Furthermore, wallets and carriers that incorporate multiple functions are known in the art. For example, U.S. Pat. No. 4,741,372 to Santilli describes a unique wallet for carrying a plurality of cards.

U.S. Pat. No. 4,716,948 to Brissette describes a wallet sized to fit folded into the breast pocket of a jacket for use by pari-mutuel bettors to organize their cash and notes and pari-mutuel tickets. The wallet contains two identical pockets for separating betting cash from winning cash, three identical slots for storing purchased pari-mutuel tickets arranged one above the other by events, a fourth slot spaced from the other three slots for storing winning tickets, a slot for a pad of notepaper and a sleeve for holding a pen or pencil. However in such a wallet design, it is only the back sheet of a pad of notepaper that is held in the slot and there is provided no retainer to hold the remaining pages flat for easy removal of single sheets or to protect the pad of notepaper from damage as the wallet is opened and closed. Additionally, inclusion of a pad of notepaper in such a wallet substantially increases the bulk and overall thickness of the wallet.

U.S. Pat. No. 5,222,764 to Dyer describes a generally pocket-sized rectangular wallet with one or two outer pockets for carrying folded imprinted sheets of standard size writing paper and a loop for holding a pen or pencil. However, the design of this wallet is such that when the folded sheets of paper are carried in the outside pockets the overall thickness of the wallet is substantially increased resulting in a rather bulky wallet, which while suitable for carrying in a purse, checkbook or the like, is less than ideal for carrying in a clothing pocket U.S. Pat. No. 6,619,349 to Gribovsky describes a billfold having a pocket that permits currency to be placed therein in an unfolded orientation and a pocket sized to receive a standard checkbook. The checkbook pocket also has a retaining strap attached thereto to receive a portion of the checkbook and to substantially prevent the checkbook from moving laterally in the pocket, however the surface of the checks are protected by the checkbook and not by any function of the billfold. Furthermore this billfold has no provision for a writing instrument and a protected paper pad integrated therein.

U.S. Design Pat. D523473 to Regala depicts a pocketable note holder with an attached means for holding a writing instrument. However, this device design does not depict a means of retaining and/or securing the writing paper nor does it depict means for any additional carrying functions.

U.S. Pat. No. 6,554,519 to Kaplan describes a note pad holder with integrated writing instrument comprising a rigid molded plastic box with a hinged lid to hold a pad of paper and a writing instrument. However, such a device is designed to perform a single function and offers no provision for carrying paper money, credit cards and the like. Furthermore, since this box device is fabricated from a rigid material such as molded rigid plastic it lacks suitability to be comfortably carried in a clothing pocket.

Therefore, in light of the known art there exists a need for a multifunctional billfold or wallet comprising means to receive and carry credit cards, identification cards, paper money and the like while having a protected paper pad and a writing utensil integrated therein and wherein the billfold or wallet maintains a slim and compact profile when in use. There also exists a need for a billfold or wallet comprising a means for carrying a protected notepad wherein single sheets can be easily removed without the disturbing the notepad as a whole. Embodiments of the present invention address these and other needs.

SUMMARY OF THE INVENTION

Figure 1:
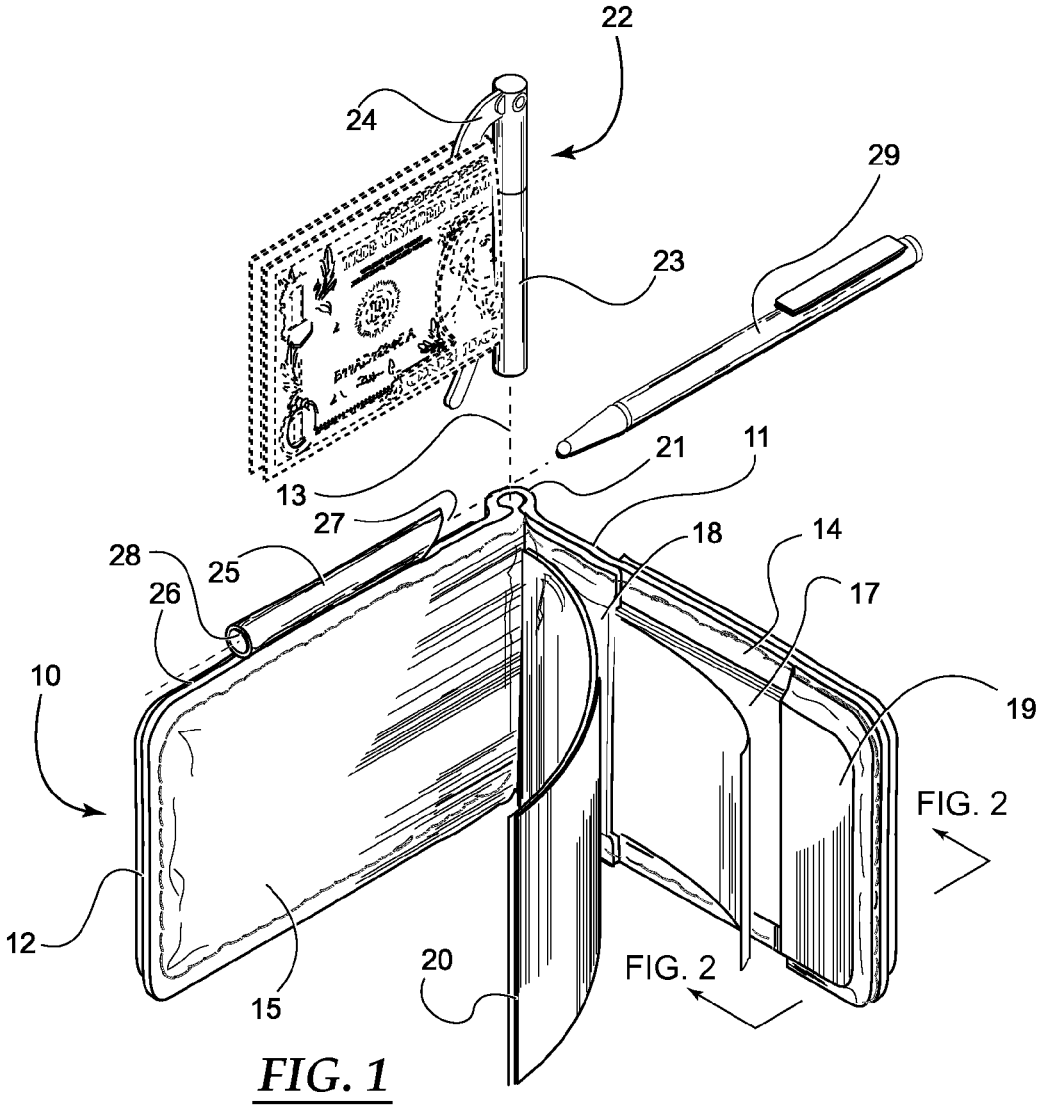
FIG. 1 depicts a partially exploded perspective view of a billfold in a partially open position with folded paper money, a notepad and a writing utensil.

Embodiments of the present invention provide a billfold or wallet with an integrated protected notepad holder, an integrated holder for a writing utensil and an integrated holder for a two-legged money clip; wherein the billfold or wallet is relatively small in size and convenient to carry in a clothing pocket and is designed to be ergonomically easy to use. In certain embodiments the outer surfaces of the billfold also comprise a plurality of outer pockets sized to retain standard size cards such as credit cards, drivers licenses, ID cards and the like.

In preferred embodiments the billfold is designed and constructed to retain a small standard notepad, such as the readily available Staples® Stickies™ adhesive notes (available from Staples, Framingham, Mass.) and Post-it® brand notes (manufactured by 3M Co. Minneapolis, Minn.), within a recess wherein the notepad is held in place by retaining panels that cover two parallel edges of the notepad and have adequate elasticity to conform and maintain sufficient pressure on the pad to hold the pad in place as individual sheets are removed. A pliable notepad-protecting flap is affixed within the billfold is situated to cover the face of the notepad. Also, embodiments of the billfolds of the present invention are designed and constructed to minimize overall thickness or bulk by providing a recess precisely sized to hold the notepad.

Embodiments of the present invention can fabricated from any of the various types of natural leathers, imitation leathers, pliable plastics compositions including blends and laminates, textiles, fabrics and combinations thereof. Preferred embodiments are fabricated from natural leathers.

DETAILED DESCRIPTION OF THE INVENTION

For purposes of the present invention the terms 'billfold' and 'wallet' are synonymous and the terms 'writing utensil' and 'writing instrument' are synonymous.

The essence of embodiments of the present invention is a billfold comprising a first rectangular body panel with an outer surface and an inner surface and a second rectangular body panel with an outer surface and an inner surface, wherein the two rectangular body panels are hingedly joined along a folding axis such that the billfold can be selectively folded to be in a closed position or an opened position and wherein the inner surface of one rectangular body panel comprises an essentially rectangular recessed contour positioned such that the edges are parallel to the edges of a rectangular body panel and dimensioned to receive a standard. The inner surface of the rectangular body panel containing the recessed contour also comprises two retaining panels positioned to cover at least a portion of the opposing edges of the rectangular recess that are parallel to the folding axis, such that retaining panels function to secure a notepad carried within the rectangular recess. Additionally the billfold may further comprise an essentially rectangular flap, dimensioned to completely cover the rectangular recess, wherein one edge of the flap is attached along the folding axis at the union of the first and second rectangular body panels such that the flap functions to protect a notepad carried within the rectangular recess. In preferred embodiments the flap is fabricated from a material that is pliable or flexible.

The billfold further comprises a holder or retainer for a two-legged money clip wherein the holder or retainer is in the form of a cylindrical sleeve attached along its longitudinal axis to the outer edges of the first rectangular body panel and/or the second rectangular body panel along the hinged axis and wherein the first cylindrical sleeve is open-ended and is dimensioned to receive one leg of the two legged money clip. In preferred embodiments the first cylindrical sleeve is integral with respect to the construction of the billfold. For purposes of the present invention suitable two-legged money clips have first and second legs pivotally attached to one another, wherein the pivot attachment means is a hinge, a spring or any other suitable mechanism designed to apply force to the legs to retain varying quantities of folding or paper money held there between. In preferred embodiments the legs of the money clip are pivotally attached by means of a hinge. In use the first leg of the two-legged money clip is disposed within the first cylindrical sleeve retainer such that the second leg is disposed within the billfold when the billfold is in a closed position, i.e. when the inner surface of the two rectangular body panels are opposed.

Also fixedly attached or integral to the construction of the billfold is a holder or receptacle designed and dimensioned to receive and hold a writing utensil. In preferred embodiments the writing utensil receptacle comprises a cylindrical sleeve, fixedly attached along an outer edge of either the first or second rectangular body panel and is dimensioned to accept and retain a writing utensil. In certain embodiments the writing utensil receptacle is open at both ends, while in certain other embodiments the writing utensil receptacle is open at one end and closed at the other end. The embodiments wherein one end of the writing utensil receptacle is closed are particularly useful when the writing utensil has an unprotected tip, e.g. a sharpened wooded pencil or uncapped pen. In such situations the closed end of the writing utensil receptacle functions as a tip protector. Also, in such embodiments the closed end may further comprise an integrated rigid insert dimensioned to cover the tip of the writing utensil to provide further protection.

In certain preferred embodiments the cylindrical sleeve that functions to receive and hold a writing utensil is constructed of the same material used to construct the body of the billfold, while in certain other embodiments such a cylindrical sleeve is fabricated from natural leathers, nylons, elastics, textile fabrics and the like as well as any combination thereof.

In certain embodiments the billfold further comprises at least one pocket dimensioned to receive at least one standard size credit card and affixed to the outer surface of at least one of the rectangular body panels. In certain preferred embodiments the billfold comprises two or more pockets dimensioned to receive at least one standard size credit card affixed to the outer surface of at least one of the rectangular body panels, wherein the two or more pockets are disposed one upon the other such that they overlap.

In some embodiments the billfold comprises one or more pockets dimensioned to receive at least one standard credit card and affixed to an inner surface of at least one rectangular body panel. In certain other embodiments such an inner pocket is fabricated from a material that is transparent or translucent.

Alternatively, in certain embodiments of the invention the notepad holding function performed by the retaining panels in the above embodiments is performed by an integral sheet-like structure covering and fixedly attached to the inner surface and having a cutout section therein that is dimensioned to cover the two edges of the recess that are parallel to the folding axis.

An important feature of preferred embodiments is the rectangular recess within the inner surface of the first body portion, since this recess permits the carrying of a notepad within the wallet without increasing the profile or thickness of the wallet. Furthermore, in preferred embodiments the notepad retaining panels are fabricated from a pliable or flexible material having sufficient elasticity such that the retaining panels conform and maintain a pressure on the notepad sufficient to hold the notepad in place while being written upon and/or while individual sheets are removed from the pad. Essentially, embodiments of the present invention permit the facile removal of single sheets from a notepad without disturbing the remaining sheets. Also the recess allows for carry a notepad in the wallet without substantially increasing the overall thickness or bulk (profile) of the wallet. Furthermore, in preferred embodiments of the present invention the rectangular recess is dimensioned and constructed to receive any of a variety of small standard note pads such as the readily available Staples® Stickies™ adhesive notes (available from Staples, Framingham, Mass.) or Post-it® brand notes (manufactured by 3M Co. Minneapolis, Minn.) Post-it® brand notes (manufactured by 3M Co. Minneapolis, Minn.).

Writing utensils, useful in embodiments of the present invention include any of a variety of conventional writing instruments, including but not limited to, wooden pencils, ballpoint pens, felt pens, gel ink cartridge pens, mechanical pencils, marker type pens and crayon-type writing instruments.

Material of construction useful for the fabrication of embodiments of the present invention includes, but is not limited to, any of the various types of natural leather, imitation leather, pliable plastic compositions including blends and laminates, elastic compositions, textiles, fabrics and combinations thereof. Techniques suitable for joining or attaching the components of embodiments of the invention include, but are not limited to, sewing, stitching, gluing, heat-sealing, thermal welding, stapling, and combinations thereof.

Figure 2:
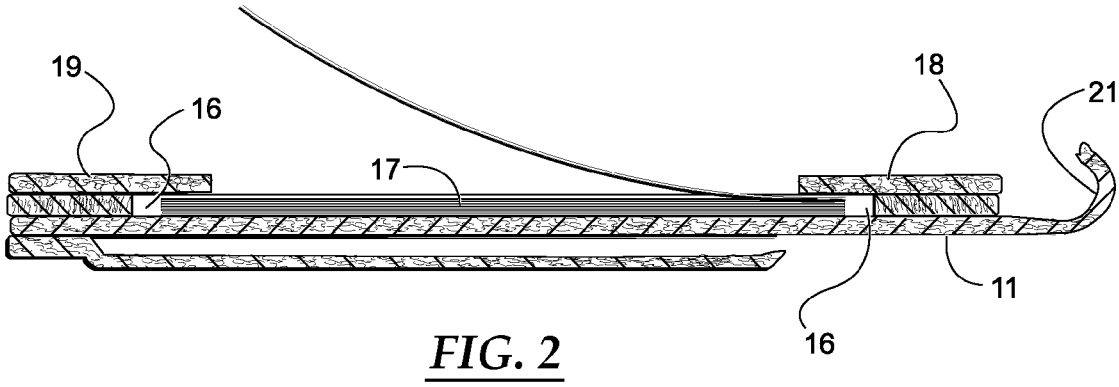
FIG. 2 depicts an orthogonal view of a cross section of the notepad-containing body panel of the billfold illustrated in FIG. 1.

A preferred embodiment of the present invention is presented in FIG. 1 wherein the billfold 10 is illustrated in an exploded perspective view and in FIG. 2, which depicts an orthogonal view of a cross section of a portion of the billfold illustrated in FIG. 1. The billfold 10 comprises a first body portion 11, with an inner surface 14, hingedly joined to a second body portion 12, with an inner surface 15 along a folding axis 13. The inner surface 14 of the body potion 11 comprises a recessed contour 16, which is sized to accept a standard notepad 17. A first retaining panel 18 is affixed along three outer edges to inner surface 14 adjacent to and parallel to the folding axis 13 such that the retaining panel 18 secures the edge portion of the notepad 17 that is proximal to the folding axis 13. A second retaining panel 19 is affixed along three outer edges to inner surface 14 and is positioned parallel to the folding axis 13 and along the edge opposite the folding axis 13 such that the retaining panel 19 secures the edge portion of the notepad 17 that is distal to the folding axis 13. Also illustrated in FIG. 1 as a component of the billfold 10 is a generally rectangular pliable flap 20 dimensioned to completely cover the notepad 17, which is disposed in recessed contour 16; wherein an edge of flap 20 is fixedly attached along the folding axis 13 at the union of the inner surface 14 and the inner surface 15 such that the flap functions to protect notepad 17 when the billfold 10 is closed.

The billfold 10 further comprises an open-ended first cylindrical sleeve 21 attached along its longitudinal axis to the outer edges of the first body portion 11 and the second body portion 12 along the hinged axis 13; wherein the first cylindrical sleeve 21 is dimensioned to accept and retain a first leg 23 of a hinged two legged money clip 22 such that the second leg 24 is disposed inside of the billfold 10, i.e. the between the inner surface 14 and inner surface 15 when is billfold 10 is closed. Such a configuration allows the money clip 22 to be conveniently and removedly attached to the billfold by inserting leg 23 into first cylindrical sleeve 21.

The billfold 10 further comprises a writing utensil receptacle in the form of a second cylindrical sleeve 25 fixedly attached along an edge 26 of body panel 12 that is perpendicular to the folding axis 13 and wherein the second cylindrical sleeve 25 dimensioned to accept and retain a writing utensil 29. In this embodiment the second cylindrical sleeve 25 comprises a proximal open-end 27 and a distal open-end 28. In certain other embodiments the second cylindrical sleeve is fixedly attached along an edge of a body panel that is parallel to the folding axis.

Figure 3:
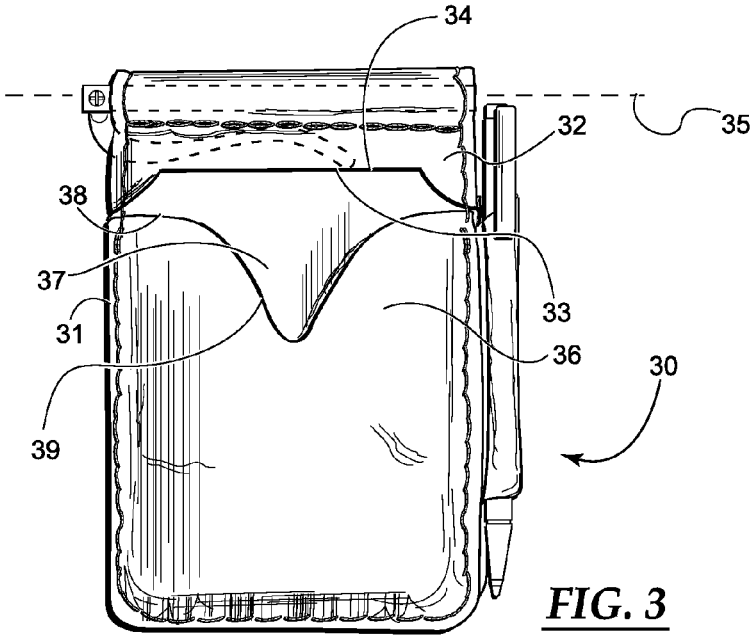
FIG. 3 illustrates a frontal orthogonal view of a billfold in a closed position having two overlapping pockets affixed to the surface.
Figure 4:
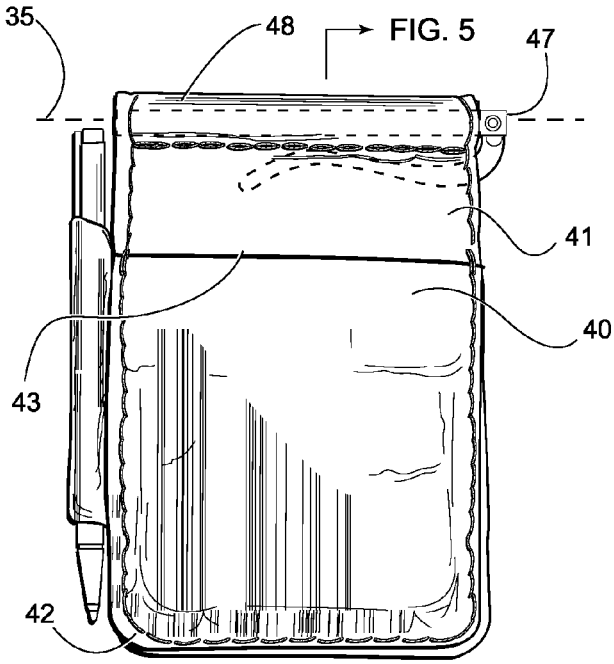
FIG. 4 illustrates a rear orthogonal view of a billfold in a closed position having one pocket affixed to the surface.
Figure 5:
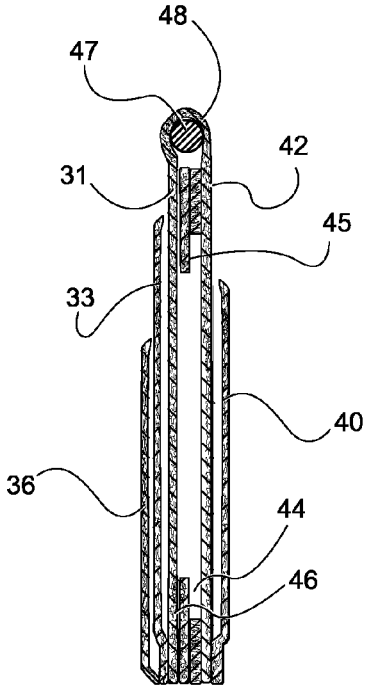
FIG. 5 depicts an orthogonal view of a cross section of the billfold illustrated in FIGS. 3 and 4.

A preferred embodiment of the present invention is illustrated in FIG. 3 wherein billfold 30 is presented in a closed position in a frontal orthogonal view. In this embodiment a first rectangular pocket panel 33 is attached along three edges to the outer surface 32 of a first body panel 31 such that the remaining unattached edge 34 is parallel to and proximal to the folding axis 35 to form a first pocket; and wherein the first pocket is dimensioned to hold at least one standard size drivers license, ID card or credit card. A second rectangular pocket panel 36 is attached along three edges to the outer surface 37 of a first rectangular pocket panel 33 such that the remaining unattached edge 38 is parallel to and proximal to the folding axis 35 to form a second pocket atop the first pocket; and wherein the second pocket is dimensioned to accommodate at least one standard size card such as a ID card or credit card. Also in this embodiment the unattached edge 38 of the second rectangular pocket panel 36 comprises a cutout portion 39, which facilitates insertion and removal of a card from the second pocket. A rear orthogonal view of billfold 30 is presented in FIG. 3 wherein a third rectangular pocket panel 40 is attached along three edges to the outer surface 41 of a second body panel 42 such that the remaining unattached edge 43 is parallel to and proximal to the folding axis 35 to form a third pocket; and wherein the third rectangular pocket panel 40 is dimensioned such that the third pocket can accommodate at least one standard size ID card or credit card. In FIG. 5 is presented an orthogonal end view of a cross section of the billfold of FIGS. 3 and 4 that clearly illustrates the relationship of the pocket panels 33, 36, 40 to the body panels 31 and 42. Also illustrated in FIG. 5 are a notepad accommodating recess 44 and the notepad retaining panels 45 and 46. Also illustrated in FIGS. 3, 4 and 5 is a two-legged money clip 47 disposed within a cylindrical sleeve 48. It is also clearly shown that in this embodiment the body panels 31 and 42 are formed from single piece of material, which is folded about axis 45 to form the cylindrical sleeve 48. Although a pliable flap, such as flap 20 as shown in FIG. 1, is not depicted in FIG. 5 it is understood that such a flexible or pliable flap an optional feature of this embodiment.

Figure 6:
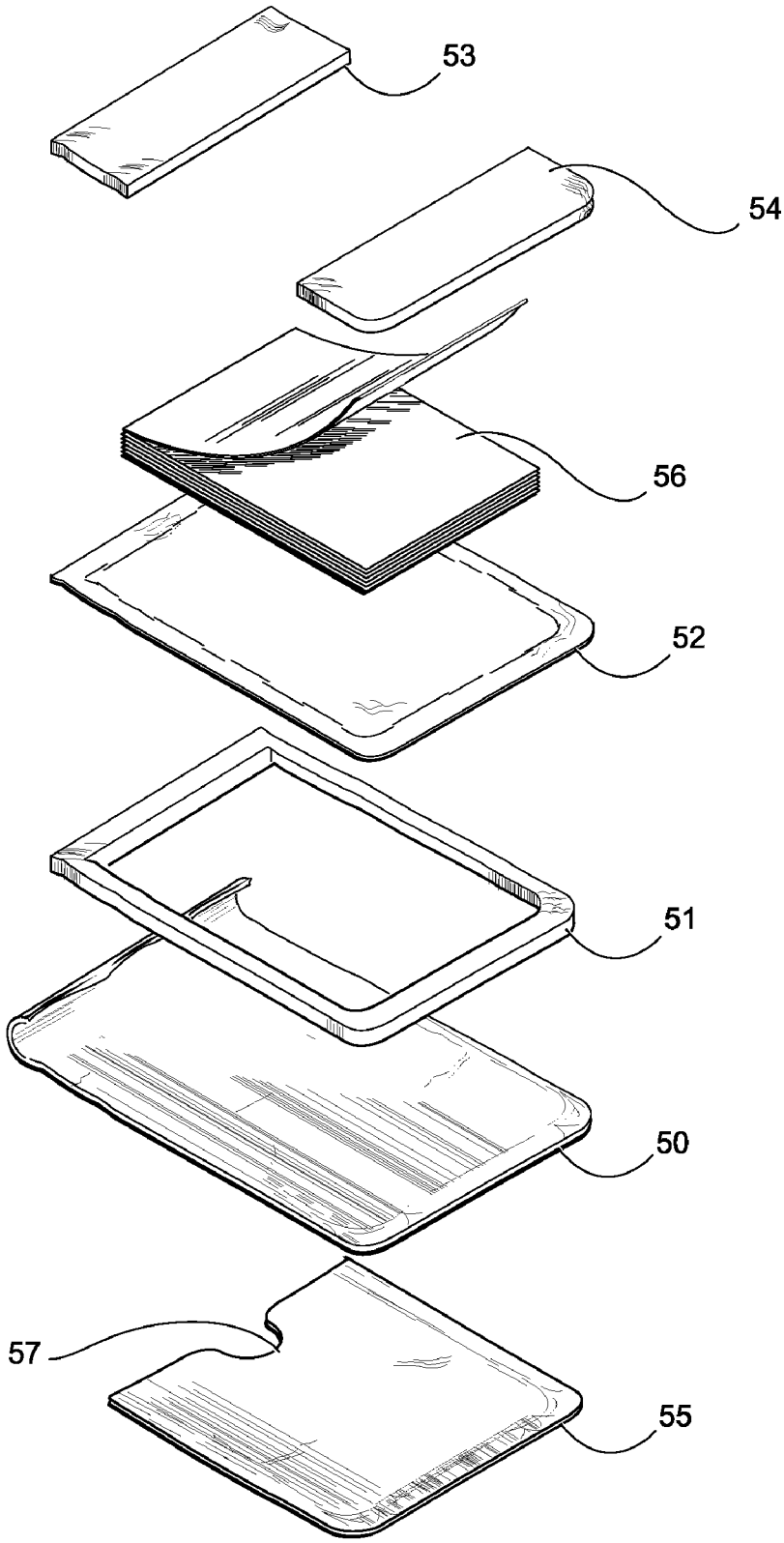
FIG. 6 illustrates a component assembly view of a billfold body panel comprising a rectangular recessed contour for accommodating a notepad.

In FIG. 6 is presented a component assembly view that clearly illustrates the construction of an embodiment of a rectangular body panel 50 comprising a rectangular frame component 51, a pliable rectangular inner wall panel 52 and notepad retaining panels 53 and 54. When the components are assembled the inner wall panel 52 conforms to the contours of the frame component 51 affording a recessed contour sized to accommodate a standard notepad 56. In most preferred embodiments the frame component 51 is of approximately the same thickness as the notepad 56. The embodiment of FIG. 6 further comprises a single pocket panel 55 with the open edge shaped to form a recess or cutout such as 57.

Figure 7:
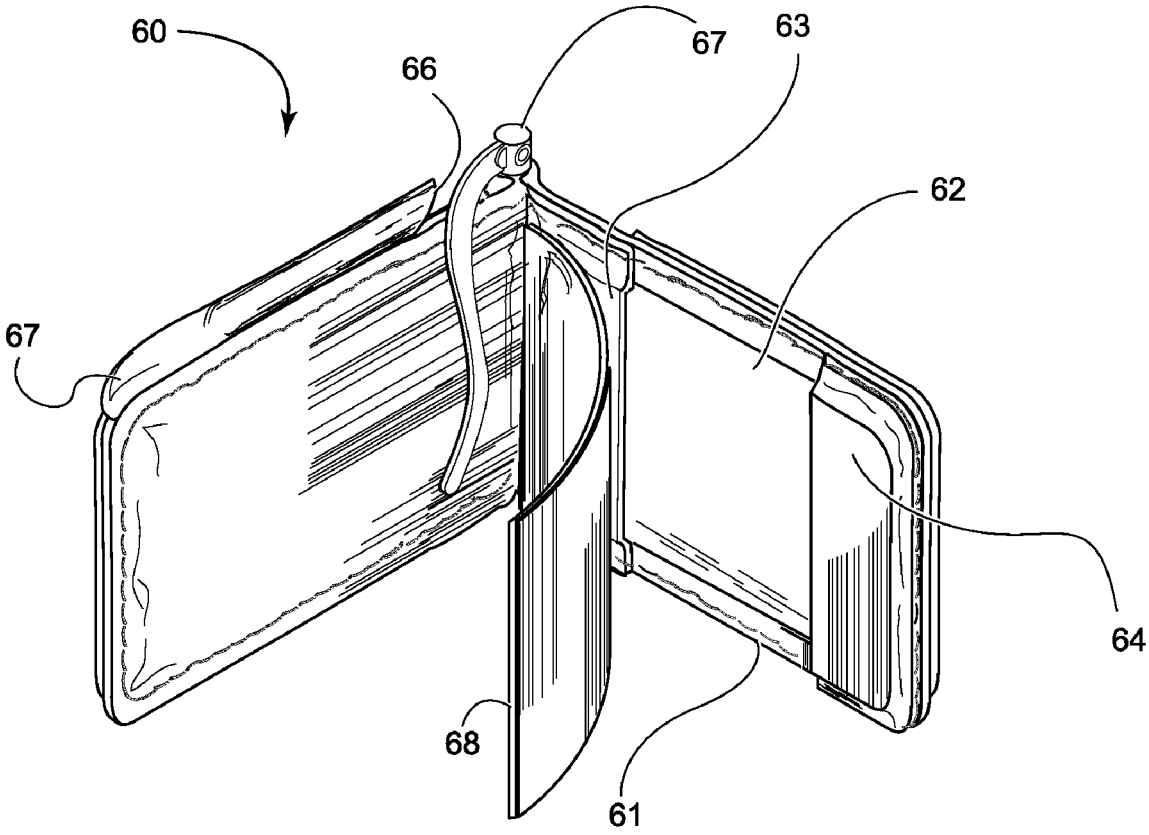
FIG. 7 is a perspective view of a billfold in a partially open position.

Another preferred embodiment of the present invention is presented in FIG. 7 wherein a perspective view of a billfold 60 in an open position is depicted. The billfold 60 comprises: a first body panel 69 and a second body panel 61 joined along a folding axis, wherein the second body panel 61 has an inner surface recessed contour 62 sized to accommodate a standard notepad; a first notepad retaining panel 64 and a second notepad retaining panel 65; a generally rectangular flexible flap 68 dimensioned to completely cover the inner surface recessed contour 62, wherein an edge of flexible flap 68 is fixedly attached along the folding axis at the union of body panel 61 and body panel 69; and a money clip 67. The flexible flap 68 functions to protect a notepad disposed within the recessed contour 62 when the billfold 60 is closed.

The billfold 60 further comprises a writing utensil receptacle in the form of a cylindrical sleeve 65 attached along the top edge of body panel 69, wherein the cylindrical sleeve 65 is dimensioned to accept and retain a writing utensil. In this embodiment the cylindrical sleeve 65 comprises an open-end 66 proximal to the folding axis and a closed end 67 distal to the folding axis.

Although the writing utensil receptacles in the form of a cylindrical sleeves described and illustrated for embodiments of the present invention are fixedly attached to the edges of the body panels, such attachment means is not to be construed as limiting. In other embodiments attachment means such as Velcro, zippers, snaps and the like may be employed to render such writing utensil receptacles removable.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof.

What is claimed is:

1. A billfold comprising:

two rectangular body panels each having an outer surface and an inner surface, wherein the two rectangular body panels are hingedly joined along a folding axis such that the billfold can be selectively folded to be in a closed position or an opened position; wherein the inner surface of one rectangular body panel comprises:

an essentially rectangular recessed contour positioned such that the edges are parallel to the edges of the second rectangular body panel and dimensioned to receive a standard notepad;

a first retaining panel positioned to cover the edge of the rectangular recessed contour that is adjacent to and parallel to the folding axis;

a second retaining panel positioned to cover the edge of the rectangular recessed contour that is opposite the edge covered by the first retaining panel, wherein the first and second retaining panels are fabricated from a material having sufficient elasticity to conform and maintain pressure on the notepad thereby functioning to secure the notepad carried within the rectangular recessed contour;

a first open-ended cylindrical sleeve attached along its longitudinal axis to an outer edge of at least one of the two rectangular body panels along the folding axis, wherein the first cylindrical sleeve is dimensioned to receive one leg of a two-legged money clip; and a second cylindrical sleeve attached along its longitudinal axis to an edge of at least one of the two rectangular body panels that is perpendicular to the folding axis, wherein the second cylindrical sleeve comprises a least one open end and is dimensioned to accommodate a writing instrument.

2. The billfold of claim 1 further comprising an essentially rectangular flap dimensioned to completely cover the rectangular recessed contour, wherein one edge of the flap is attached to the inner surface of the one rectangular body panel along the folding axis such that the flap functions to protect a notepad carried within the rectangular recessed contour.

3. The billfold of claim 2 wherein the flap is fabricated from a pliable or flexible material.

4. The billfold of claim 1 further comprising a money clip comprising a first leg disposed within said first cylindrical sleeve and pivotally joined to a second leg disposed between the inner surface of the first rectangular body panel and the inner surface of said second rectangular body panel when the billfold is in a closed position.

5. The billfold of claim 1 further comprising at least one pocket panel affixed to the outer surface of at least one of the two rectangular body panels and dimensioned to receive at least one standard size credit card.

6. The billfold of claim 1 further comprising two or more pocket panels, dimensioned to receive at least one standard size credit card, affixed to the outer surface of at least one of the two rectangular body panels, wherein said two or more pockets panels are disposed one upon the other such that they overlap.

7. The billfold of claim 1 wherein said second cylindrical sleeve has two open ends.

8. The billfold of claim 1 fabricated from materials chosen from the group consisting of natural leathers, imitation leathers, flexible plastics, flexible plastic laminates, elastic compositions, textiles and combinations thereof.

9. The billfold of claim 8 fabricated from natural leathers.

10. The billfold of claim 4 wherein the first leg of the money clip and the second leg of the money clip are pivotally joined by a hinge.

11. The billfold of claim 4 wherein the first leg of the money clip and the second leg of the money clip are pivotally joined by a spring.

12. The billfold of claim 1 further comprising a writing instrument disposed within the second cylindrical sleeve.

13. The billfold of claim 1 further comprising a notepad disposed within the rectangular recessed contour.

14. The billfold of claim 1 dimensioned to fit into a clothing pocket.

* * * * *